US005881571A

United States Patent [19]

Reester

[11] Patent Number: 5,881,571

[45] Date of Patent: Mar. 16, 1999

[54] STITCH CAM FOR A CIRCULAR KNITTING MACHINE

[75] Inventor: Karl Reester, North Syracuse, N.Y.

[73] Assignee: Tompkins Brothers Company, Inc., Syracuse, N.Y.

[21] Appl. No.: 902,281

[22] Filed: Jul. 29, 1997

Related U.S. Application Data

[60] Provisional application No. 60/027,674 Oct. 7, 1996.

[51] Int. Cl.[6] ..... D04B 9/06

[52] U.S. Cl. ..... 66/54; 66/27; 66/123

[58] Field of Search ..... 66/27, 54, 121, 66/123

[56] References Cited

U.S. PATENT DOCUMENTS

| | | | |
|---|---|---|---|
| 3,869,879 | 3/1975 | Brunner | 66/54 |
| 3,882,694 | 5/1975 | Stepanek et al. | 66/54 |
| 3,961,499 | 6/1976 | Stepanek et la. | 66/54 |
| 4,048,817 | 9/1977 | Bianchi | 66/57 |
| 4,996,853 | 3/1991 | Brega . | |
| 5,182,927 | 2/1993 | Pernick . | |
| 5,577,401 | 11/1996 | Pernick . | |
| 5,609,044 | 3/1997 | Tacy . | |

*Primary Examiner*—Andy Falik
*Attorney, Agent, or Firm*—Wall Marjama Bilinski & Burr

[57] ABSTRACT

A stitch cam for a circular knitting machine using needles having operating butts of a predetermined height, includes a support body having a front facing surface, a first cam plate fixedly attached to the front facing surface, and a second cam plate movably attached to the fixed cam plate. When assembled, the first and second cam plates define a closed cam track having a spacing sized for accommodating the operating butt of the needles. The movable cam plate includes a pin for engaging a spiral cam cylinder of the support body to provide linear motion of the movable cam plate relative to the first cam plate to alter the position of at least a portion of the closed cam track in order to selectively raise and lower the stitch level of the needles in a circular knitting machine. The movable cam plate includes a pair of narrow angled cam track defining sections which fit into corresponding slotted portions of the fixed cam plate, defining a path of travel, and include a geometry which allows the remainder of the needle to contact only the fixed cam plate. A shim member placed between the cam plates and support body allows radial adjustment of the stitch cam relative to a needle supporting element, such as a cylinder or dial, and facilitates movement of the movable cam plate relative to the front surface of the support body, particularly when dissimilar materials are used.

17 Claims, 9 Drawing Sheets

STITCH CAM FOR A CIRCULAR KNITTING MACHINE

CROSS REFERENCE TO RELATED APPLICATION

Reference is made to and priority claimed from U.S. Provisional application Ser. No. 60/027,674 filed Oct. 7, 1996, entitled Stitch Cam For A Circular Knitting Machine.

FIELD OF THE INVENTION

This invention relates to stitch cams, and specifically to an improved stitch cam for a circular knitting machine to allow knitting needles having heels of a predetermined size to be maintained in an adjustable stitch level, and for allowing radial alignment relative to a needle supporting element.

BACKGROUND OF THE INVENTION

Circular knitting machines are known include a first needle supporting element- e.g. a cylinder, having a plurality of radial grooves defined along its periphery in which the needles are accommodated and can slide axially. Each needle includes a heel or butt having a predetermined height protruding from the grooves for engaging within a path defined by a plurality of shaped cams which are mounted on a supporting structure and are arranged with a front cam surface facing the needle supporting element.

In circular machines having two needle beds, two needle supporting elements are perpendicularly arranged, since a dial is arranged above the cylinder having a plurality of radial grooves in which other similar needles are accommodated and face the needles carried by the cylinder. Similarly, the needles of the dial also have at least one protruding heel which protrudes upwardly from the grooves of the dial and engages within paths defined by other cams mounted on a supporting structure arranged upwardly facing the dial.

The relative motion between the supporting structures of the cams and the respective needle supporting element causes the needles to follow the paths defined by the cams, moving the needles along the respective grooves of the cylinder and dial to grip the thread fed by thread guides and to form stitches. In circular machines, the relative motion occurs about the axis of the knitting machine, which coincides with the axis of the cylinder and with the axis of the dial.

Known stitch cams, such as those described in U.S. Pat. No. 5,182,927 to Pernick, lower the needles of the cylinder or move the needles of the dial after the needles have engaged the thread fed by a thread guide, to cast off the previously formed stitches in a synchronized manner. The stitch cam according to the above patent includes a fixed lower cam portion and an upper movable cam portion which are each mounted to a supporting body. The lower movable portion is adjustable from a minimum to a maximum along a line which is parallel to the angular slope of the cam to move diagonally. This adjustment is made externally through the use of an cylindrical cam utilizing an Archimedean spiral which is contained within the supporting body and is interconnected to the movable portion which slides along an obliquely angled surface of the supporting body to raise and lower the needles by a corresponding amount.

A number of problems are encountered in the above described stitch cam. First, the cam requires sliding contact between the obliquely angled surface of the upper movable portion and the corresponding angled surface of the supporting body. Therefore, dissimilar materials cannot be used for the contacting parts without producing excessive wear and producing frictional forces which could render the cam partially or completely inoperative.

A second problem is the requirement of an angled contacting surface in the supporting body which requires additional time and labor to fabricate and introduces additional potential tolerancing dilemmas between the three major components, ie: the supporting body, the movable upper cam portion and the lower fixed cam portions. Alignment between the three components must be tightly held in order to provide smoothness of movement, which is critical, particularly given the high speed and synchronous steps involved in an automatic circular knitting production operation. Variations in tolerancing may also occur when the movable cam portion is shifted to change the stitch level, wherein contacting portions of the needle separate from the heel may contact the surfaces of the fixed cam portion and the movable cam portion, thereby increasing the probability of needle breakage against a discontinuous portion or the cylinder in the case of adjacent cam assemblies having different stitch levels, and ultimately causing unwanted production delays.

Yet another problem is an inability for the needles to transition between adjacently disposed cam units on a cam supporting bed in the circular knitting machine, introducing a greater probability of needle breakage due to excessive vibration due caused by discontinuity in between adjacent closed cam tracks, particularly in machines having a smaller radius, and therefore being more pronounced between cams with different stitch levels.

Still another problem generally encountered in stitch cam units of the prior art is an inability to provide radial adjustment; that is, relative to the cylinder or other needle supporting element facing the cam.

SUMMARY OF THE INVENTION

A primary object of the present invention is to provide a stitch cam for raising and lowering needles at high yielding speeds, without significantly impacting needle damage.

Another primary object of the present invention is to provide a stitch cam unit for a circular knitting machine which allows for stitch level adjustment as well as radial adjustment of the cam supporting member relative to the needle supporting member.

Still another object of the present invention is to provide a stitch cam unit which when arranged with similar stitch cam units on a cam supporting member of a circular knitting machine allows better transition of the needles along a defined cam path, particularly between adjacent stitch cam units.

Still another primary object of the present invention is to provide a stitch cam unit of multiple components which can functionally allow the stitch level to be adjusted using a movable cam portion wherein the movable cam portion and contacting surfaces can be made from dissimilar materials.

Yet another object of the invention is to provide a circular knitting machine having adjacent stitch cam assemblies having varying stitch lengths, yet provide smooth transitions therebetween.

Therefore, and according to preferred aspect of the present invention there is provided a stitch cam assembly for use with a circular knitting machine having needles including butts of a predetermined length comprising a support body having a front face, a fixed cam plate fixedly attached to said front face, and a movable cam plate movably attached to the fixed cam plate which defines with said fixed cam plate a closed cam path which is adjustable over at least a portion thereof and sized to retain therein a butt of a needle wherein the needle includes contacting portions adjacent the butt which contact only the fixed cam plate.

According to another aspect of the present invention, there is provided a stitch cam for a circular knitting machine using needles having butts of a predetermined size, comprising a support body having a front facing surface; a fixed cam plate fixedly attached to said front facing surface; a movable cam plate movably attached to said front facing surface, said cam plates defining a closed cam track having a spacing sized for accommodating the butt of said needles; and means for moving said movable cam plate relative to said fixed cam plate to alter the position of at least a portion of said closed cam track in order to selectively raise and lower the stitch level of said needles in a circular knitting machine; and means for adjusting the radial position of the stitch cam relative to the position of a needle supporting element of a circular knitting machine, said means including a shim member disposed between said cam plates and the front facing surface of said support body.

Preferably, the movable cam plate is interconnected to a spiral Archimedean cam situated within the support body to provide movement when the spiral cam is adjusted, and in which the support body is fabricated of a lightweight material such as aluminum. A shim plate introduced between the movable cam plate and the front face of the support body facilitates movement of the movable cam plate in response to the movement of the Archimedean cam and also allows radial adjustment of the cam assembly, in the event of a dimensional mismatch between the cam supporting element and a needle supporting member (e.g. the dial or cylinder).

An advantage of the present invention is that the design of the movable cam plate insures that the needle, with the exception of the butt, contacts only the fixed cam plate, therefore significantly reducing tolerancing problems which may be introduced by the movable cam plate.

These and other objects, features, and advantages will now be described in accordance with the following Detailed Description of the Preferred Embodiments when read in light of the accompanying drawings.

DETAILED DESCRIPTION OF THE DETAILED EMBODIMENTS

The invention will now be described in terms of a particular embodiment relating to a circular knitting machine of which certain aspects are commonly known. It will be readily apparent from the foregoing that other applications embodying the concepts described herein can easily be utilized. In addition, certain terms such as "upper", "lower". "top", "bottom", "front", and "rear" are used herein to provide a frame of reference, in which such description is not intended to be limiting in application of the concepts as described and claimed.

Figure 1:
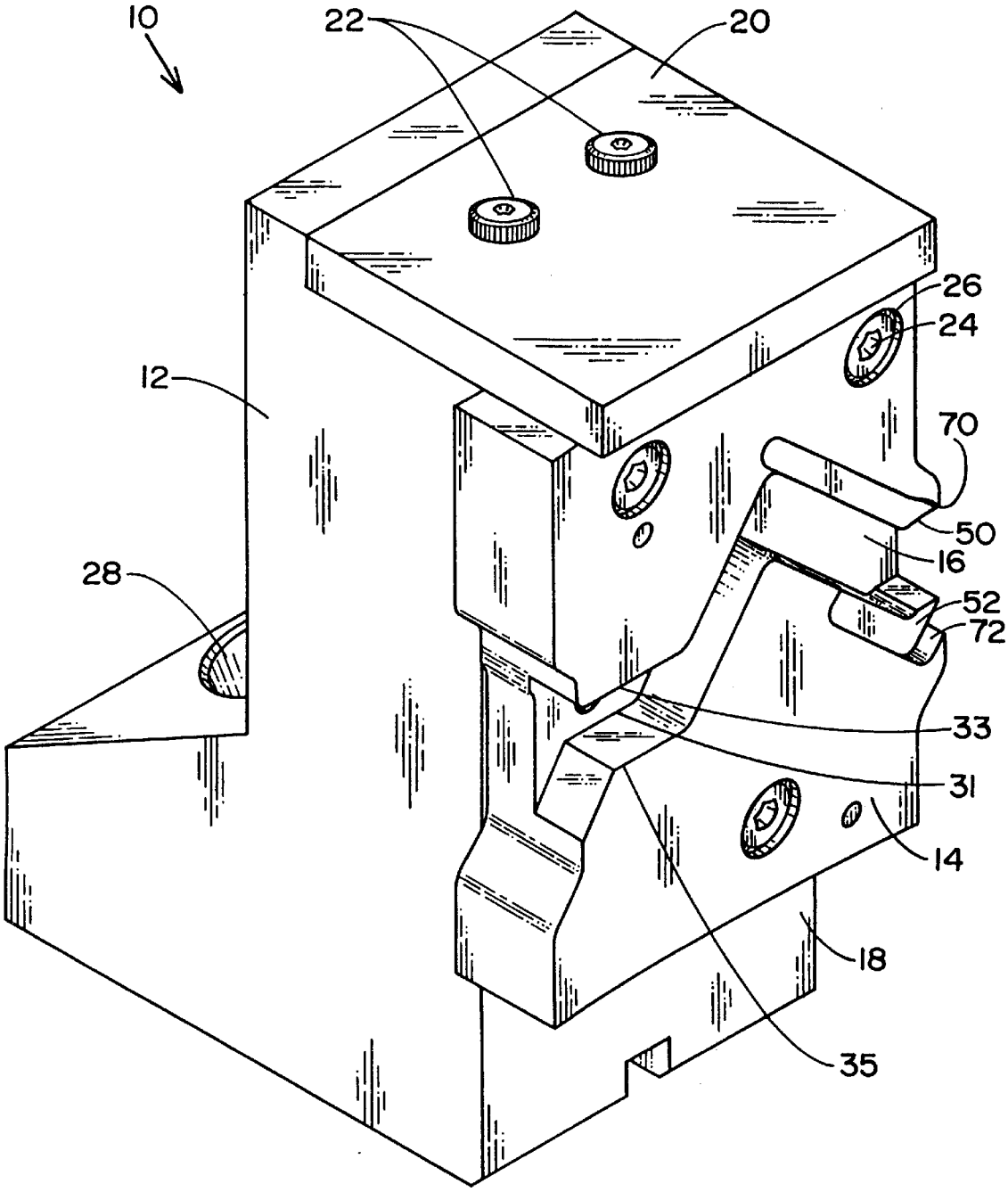
FIG. 1 is a front perspective view of a stitch cam assembly in accordance with a preferred aspect of the present invention.

Referring now to the FIGS, and in particular to FIG. 1, there is shown a stitch cam assembly 10 for use in a circular knitting machine and defined by a support body 12, a fixed first cam plate 14 and a movable second cam plate 16. The fixed cam plate 14 is assembled to a front facing surface 18 of the support body 12 by threaded fasteners, such as machine bolts 24 through a set of spaced through holes 26 and includes a defined cam track 31 including upper and lower cam surfaces 33, 35 having a spacing which is substantially equal to the height of the butt 92, shown in phantom in FIG. 9, of a knitting needle 90, FIG. 9, with the exception of a pair of slotted portions 70, 72, which are sized for accommodating upper and lower cam portions 50, 52 of the second cam plate 16, as is described in greater detail below.

The second cam plate 16 is movably attached and is retained by the fixed cam plate 14 in a manner which is described in greater detail below. The stitch cam 10 also includes a retainer plate 20, such as conventionally known in the field and attached to the top of the support body 12 by a pair of threaded fasteners 22. In use, a plurality of stitch cam assemblies 10 are circumferentially arranged on a cam supporting member or bed 100 (partially shown in FIG. 8) by attaching each cam assembly to a supporting surface 102 through an angled mounting hole 28 in the rear of the support body 12. Preferably, the support body 12 is made from a lightweight material, the body according to this embodiment being made from aluminum, while the fixed and movable cam plates 14, 16 are fabricated from a hardened steel, such as A2 tool steel.

Figure 2:
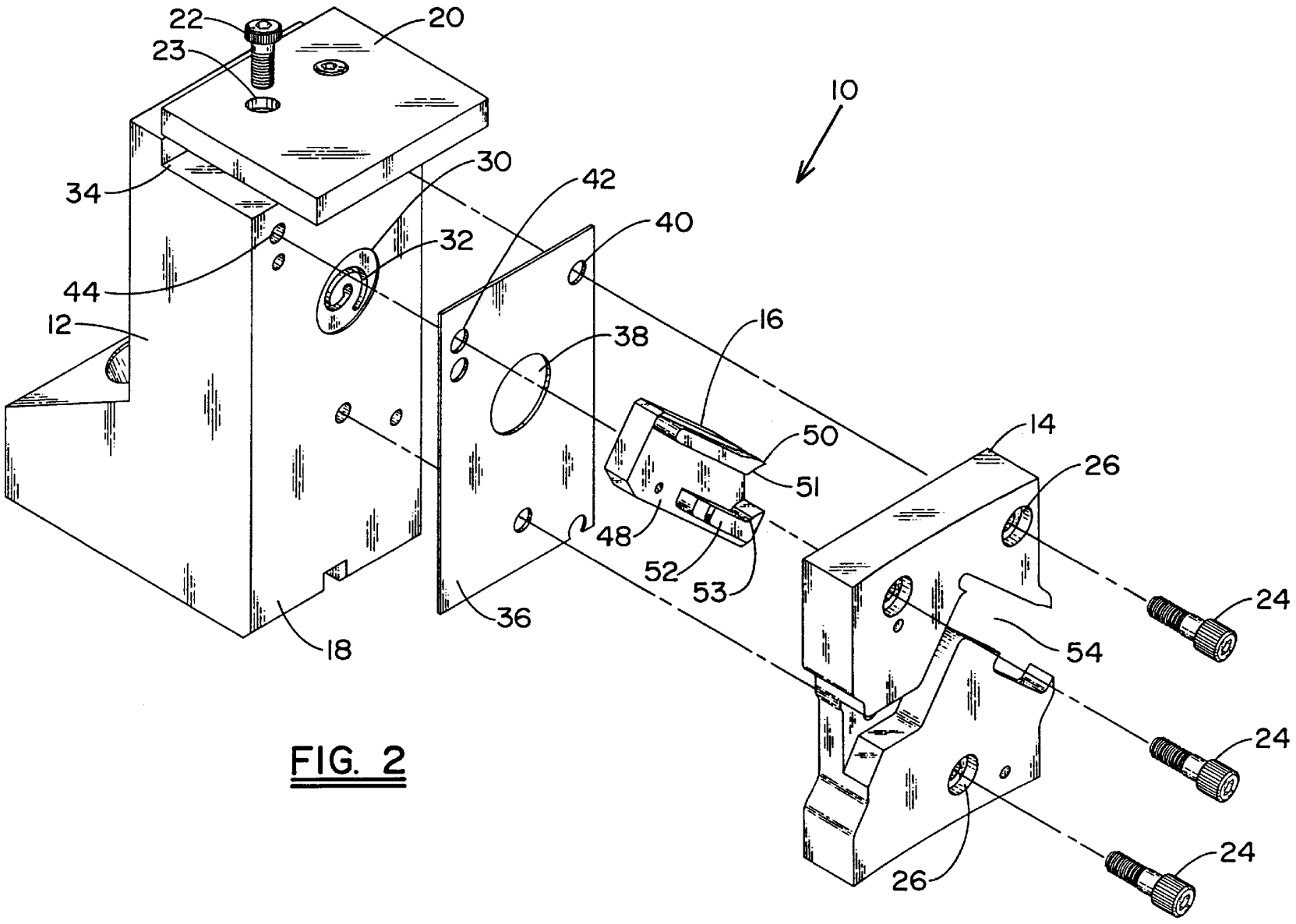
FIG. 2 is an exploded front perspective view of the stitch cam assembly of FIG. 1.

Turning to the exploded stitch cam shown in FIG. 2, the support body 12 includes an internally disposed Archimedean spiral cam 30 having an engageable spiral cam groove 32 protruding through an opening in the front facing surface 18. The spiral cam 30 is externally accessible from the rear of the support body 12 by means of an Allen wrench or other tooling (not shown) to cause the cam to rotate. Additional details relating to the spiral cam are known in the prior art; for example, as described in U.S. Pat. No. 5,182,197 issued to Pernick, the entire contents of which are incorporated by reference.

Still referring to FIG. 2, the retainer plate 20 is attached to a recessed portion 34 of a top surface of the support body 12 by the engagement of a pair of threaded fasteners 22 through corresponding holes 23 provided in the plate and support body (not shown). The retainer plate 20 forms an overhanging portion when assembled in order to insure the needle s do not extend too far upwardly from the cylinder. Such retainer plates are commonly known in the field.

Figure 3:
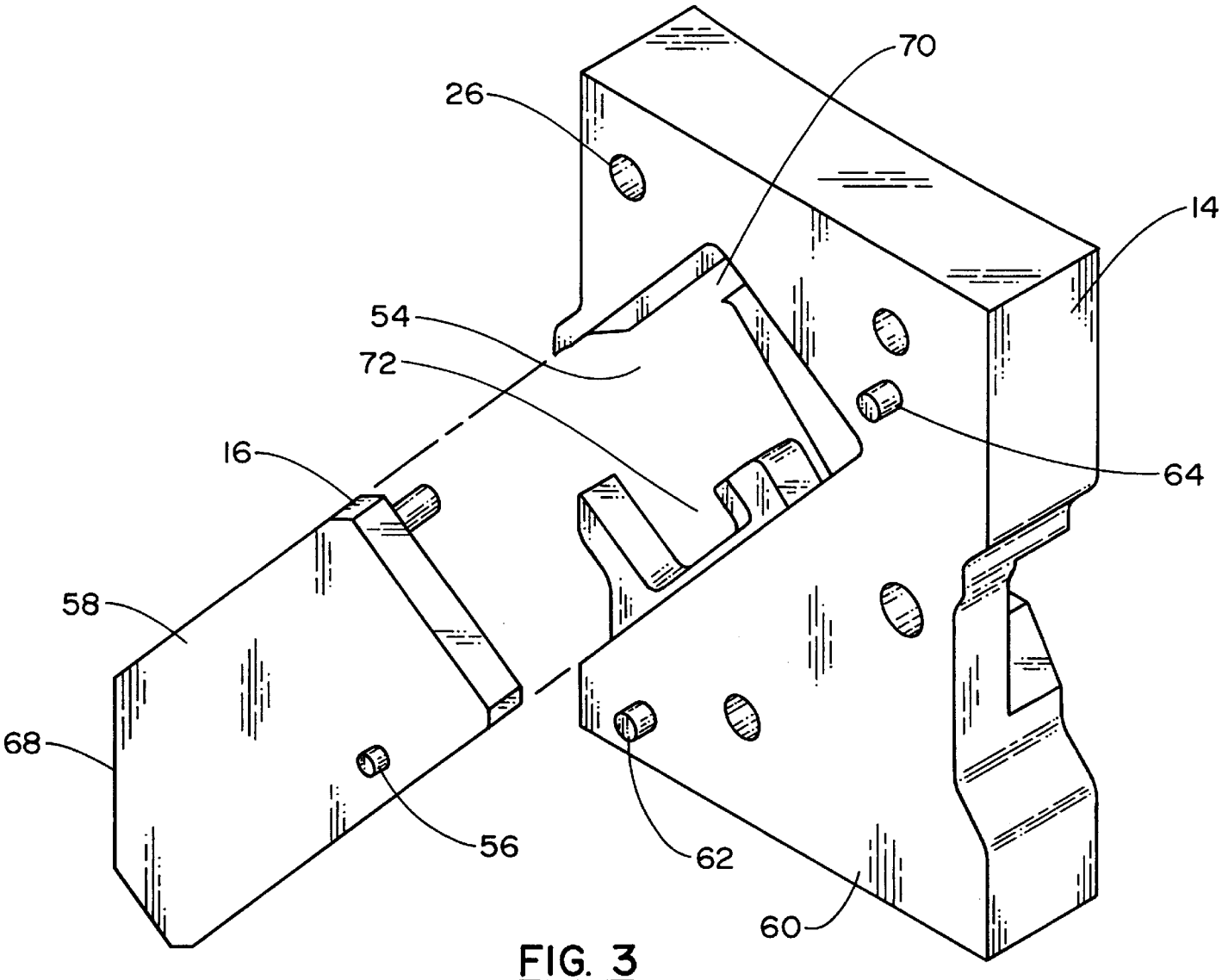
FIG. 3 is a partial rear perspective view of the stitch cam assembly of FIG. 1, showing the showing the interconnection between the movable and fixed cam plates.

A shim member 36 is disclosed between the front facing surface 18 of the support body 12 and the rear surfaces 58, 60, FIG. 3, of the assembled fixed and movable cam plates 14, 16. Preferably, the shim member 36 is fabricated from a half hardened steel for facilitating the movement of the movable cam plate 16 as is described below. For purposes of this embodiment, the shim member 36 has a thickness of about 0.100 mm, though for reasons detailed below, a variety of different thicknesses can be selected. The shim member 36 is fabricated from flat plate stock and includes a central opening 38 to allow access to the Archimedean spiral cam 30.

Referring to FIGS. 2 and 3, a projecting pin 56 located on the rear surface 58 of the movable cam plate 16 is sized for engaging the spiral cam groove 32. The shim member 36 also includes openings 40 to allow a pair of alignment pins 62, 64 projecting from the rear surface 60 of the fixed cam plate 14 to engage the front facing surface 18 of the support body 12 through corresponding openings 44.

Referring to FIG. 2, and as previously noted, the movable cam plate 16 includes an upper cam portion 50 and a lower cam portion 52 extending from a front facing surface 48 which are obliquely arranged and include lower and upper cam surfaces, 51, 53 respectively. The upper and lower cam surfaces 51, 53 are parallel to one another and form a spacing therebetween which is approximately equal to the width of a butt 92 of a knitting needle 90, shown in FIG. 9. The movable cam plate 16 is assembled in the stitch cam assembly 10 by placing the front facing surface 48 into a defined cutout region 54 of the fixed cam plate 14, and specifically by placement of the upper and lower cam portions 50, 52 into respective upper and lower slotted portions 70, 72. When assembled thereto, the respective rear surfaces 58,60, FIG. 3, of the movable cam plate 16 and the fixed cam plate 14 are coplanar and in direct bearing contact with the shim member 36.

Figure 5:
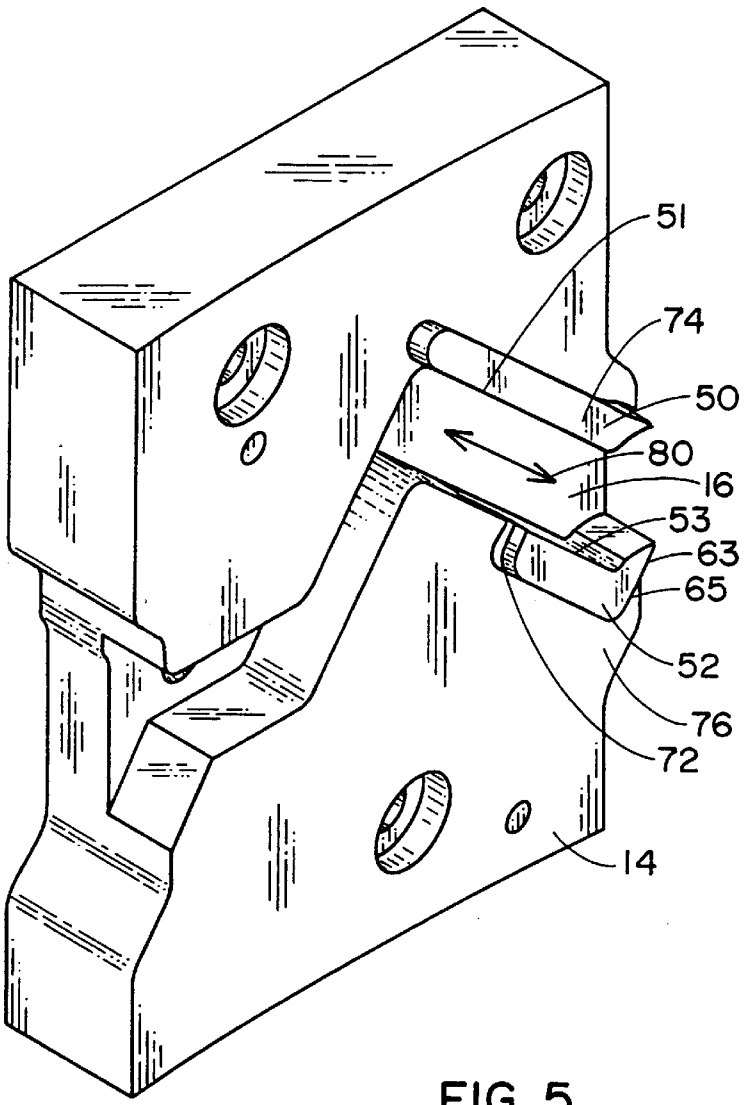
FIG. 5 is a partial front perspective view of the stitch cam assembly of FIGS. 1 and 2, showing the movable cam plate in a lowered stitch-defining position.
Figure 4:
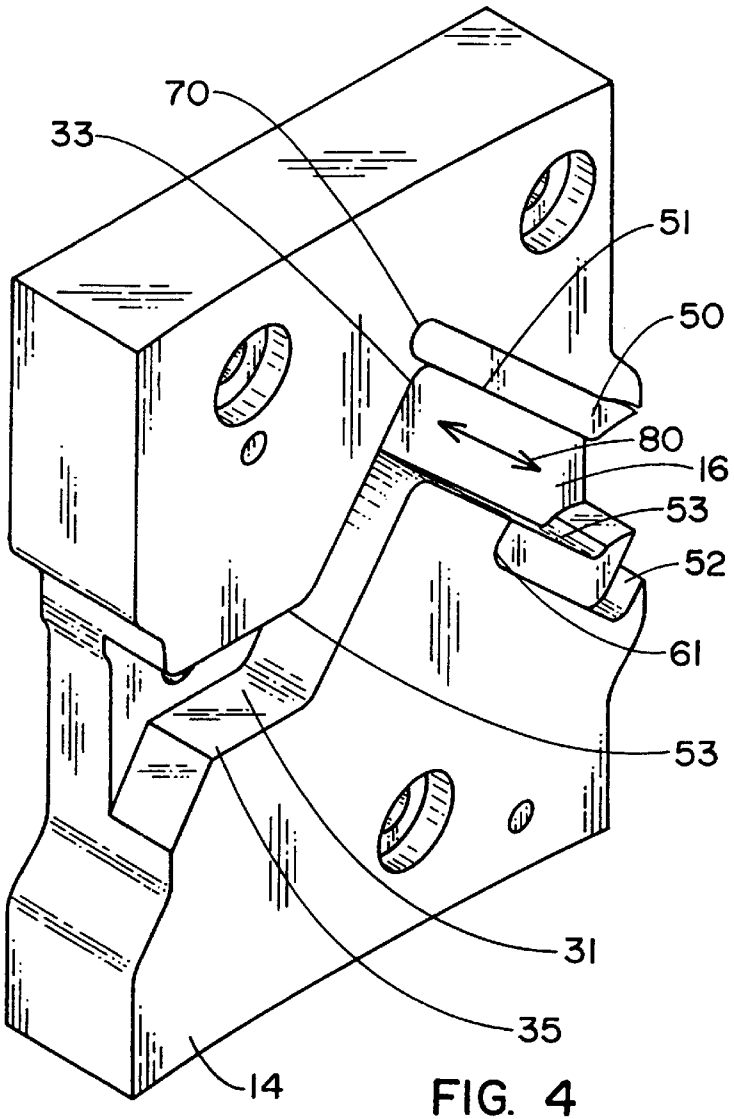
FIG. 4 is a partial front perspective view of the stitch cam assembly of FIGS. 1 and 2, showing the movable cam plate in a raised stitch-defining position.

As shown in FIGS. 4 and 5, the movable cam plate 16 moves along a path, shown as arrow 80, which is established by the oblique angle of the cutout region 54, as well as the slotted portions 70, 72. The cutout portion 54 is sized to snugly accommodate the movable cam plate 16 therein so as to only allow movement along the oblique angle established by the upper and lower slotted portions 70, 72.

In the upper stitch position shown in FIG. 4, the upper cam portion 50 of the movable cam plate 16 is retained within the slotted portion 70 and the lower cam portion 52 in contact with an upper edge 61 of the slotted portion 72.

In the lower stitch position shown in FIG. 5, the angled end surface 63 of the lower cam portion 52 engages an inclined edge 65 of the lower slotted portion 72, while the upper cam portion 50 is still retained by the slotted portion 70. The upper and lower slotted portions 70,72 of the cutout portion 54 closely match the contour of the upper and lower cam portions 50, 52 of the movable cam plate 16 in order to allow the movable cam plate to shift the height of the closed cam track 31 to alter the stitch level. To that end, and in either position, or any intermediate position therebetween, a continuous and evenly spaced cam track 31 is maintained between the upper surface 33 of the fixed cam plate 14 and the lower cam surface 51 of the upper cam portion 50 as well as the upper surface 53 of the lower cam portion 52 and the lower cam surface 35 of the fixed cam plate 14.

Figure 6:
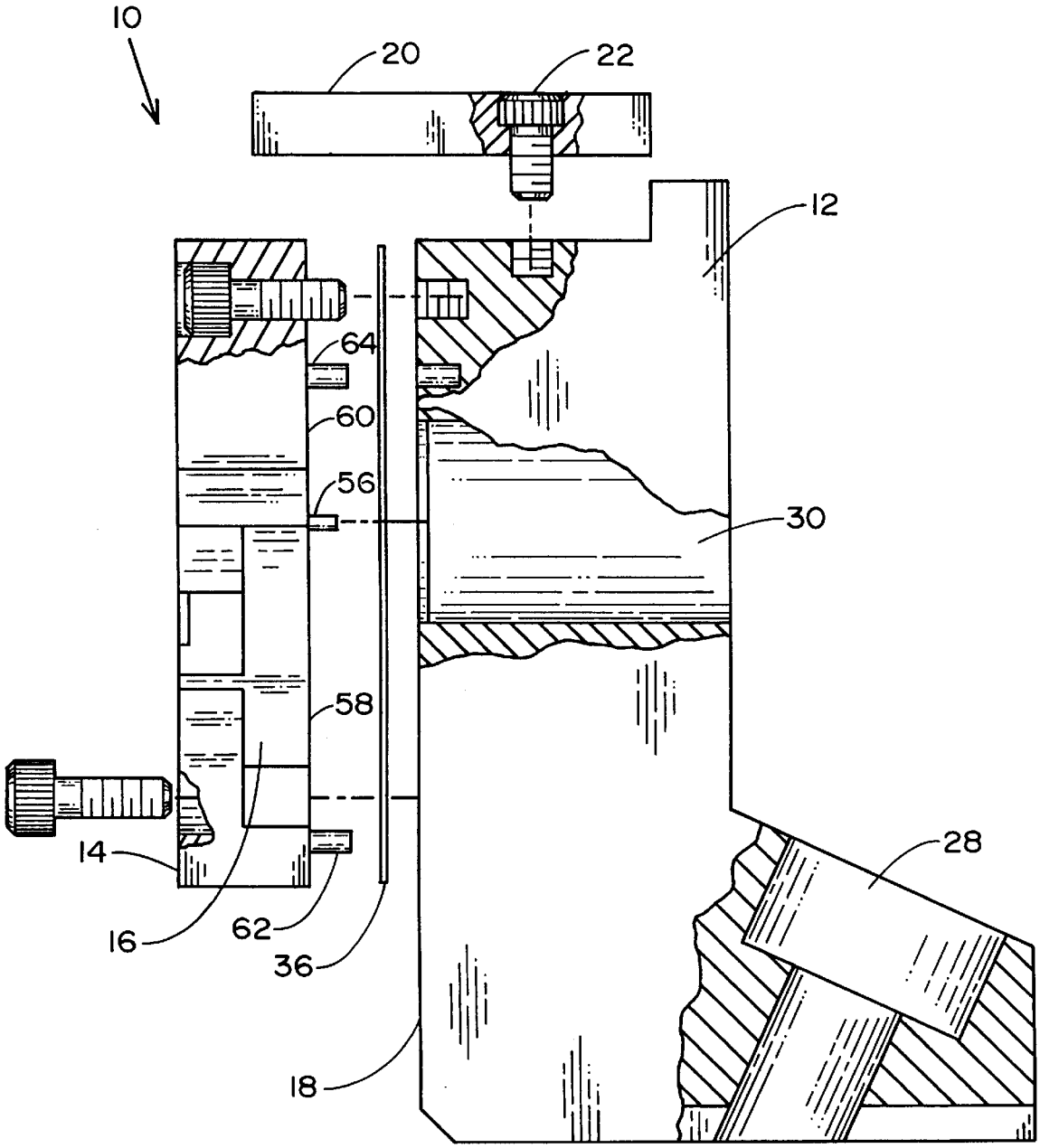
FIG. 6 is a partially exploded side view of the stitch cam assembly of FIG. 2, shown partially in section.

An exploded side view of the stitch cam assembly 10 is depicted in FIG. 6, after the movable cam plate 16 has been assembled to the fixed cam plate 14 as previously shown in FIG. 3. The presence of the shim member 36 allows intermediate contact between the rear surface 58 of the movable cam plate 16 and the front facing surface 18 of the support body 12, thereby avoiding potential wear and friction problems due to the dissimilarity in materials between the two components.

Figure 7:
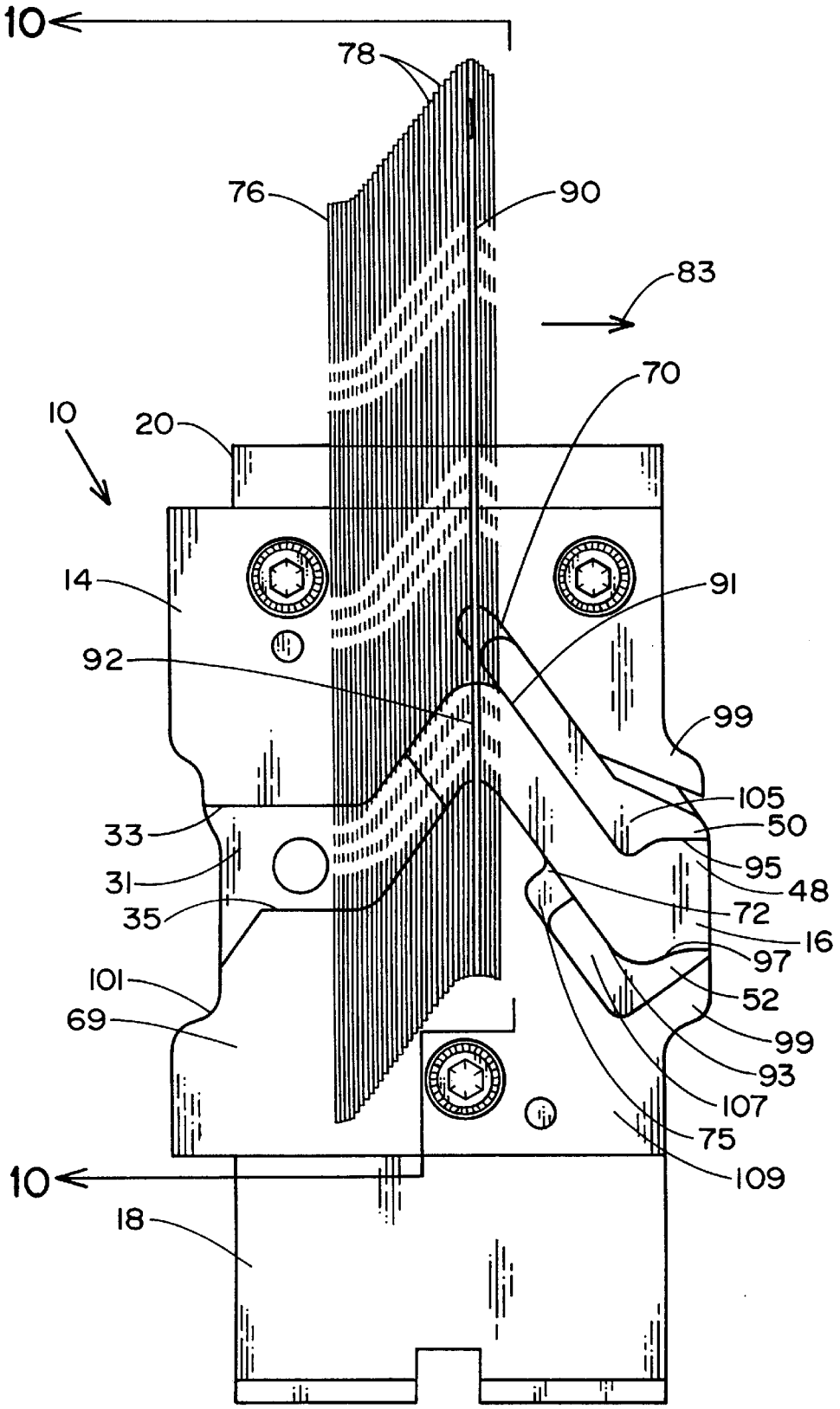
FIG. 7 is an enlarged front view of the stitch cam assembly illustrating the closed cam track formed by the movable and fixed cam plates.

Referring to FIG. 7, an operational discussion can be made of the above stitch cam assembly 10. A needle supporting member, such as a cylinder 76, having a plurality of radial grooves 78, partially shown is directly adjacent the front facing surfaces of the stitch cam assembly 10. Each of the grooves 78 contain a knitting needle 90 having a heel or butt 92 of a predetermined height (more clearly shown in FIG. 9) and which extends into the cam track 31. As the cylinder 76 rotates about the axis of the machine, per arrow 83, the plurality of needles 90 are caused to raise and fall in correspondence with the shape of the closed cam track 31 established by the fixed and movable cam plates 14, 16. From known machines, such as described in U.S. Pat. No. 4,996,853, among others, the cam supporting structure is movable relative to the needle supporting element so that the butts 92 of each of the needles 90 move along the paths defined by the fixed and movable cams, that is, each stitch cam assembly 10 forms a closed cam track 31 for closely confining the needles 90 by engagement with the upper and lower operating surfaces of the butts 92. The movable cam plate 16 is shown in the lower stitch level position, previously described in FIG. 5, with the upper and lower cam portions 50, 52 displaced within the cutout portion 54, FIG. 3, from the ends of the slotted portions 70,72, respectively with the lower cam portion 52 in contact with the lower slotted portion 72. The upper slotted portion 70 supports the upper cam portion 50 of the movable cam plate 16, while the lower slotted portion 72 retains the lower cam portion 52. Lower cam portion 69 of the fixed cam plate 14 includes a recessed shelf 75 to allow the cam track 31 to remain continuous for the moving needle 90 for engaging the operating surfaces of the butt 92 without catching or vibration.

Still referring to FIG. 7, the respective cam surfaces 51, 53 of the upper and lower cam portions 50, 52 are uniquely contoured and consist of obliquely angled portions 91, 93 in which the cam surfaces 51, 53 are parallel to the oblique angle of the cutout portion 54, and respective contour portions 95, 97 having an upward curvature to slightly raise the needle at an exit portion of the cam track 31.

Figure 8:
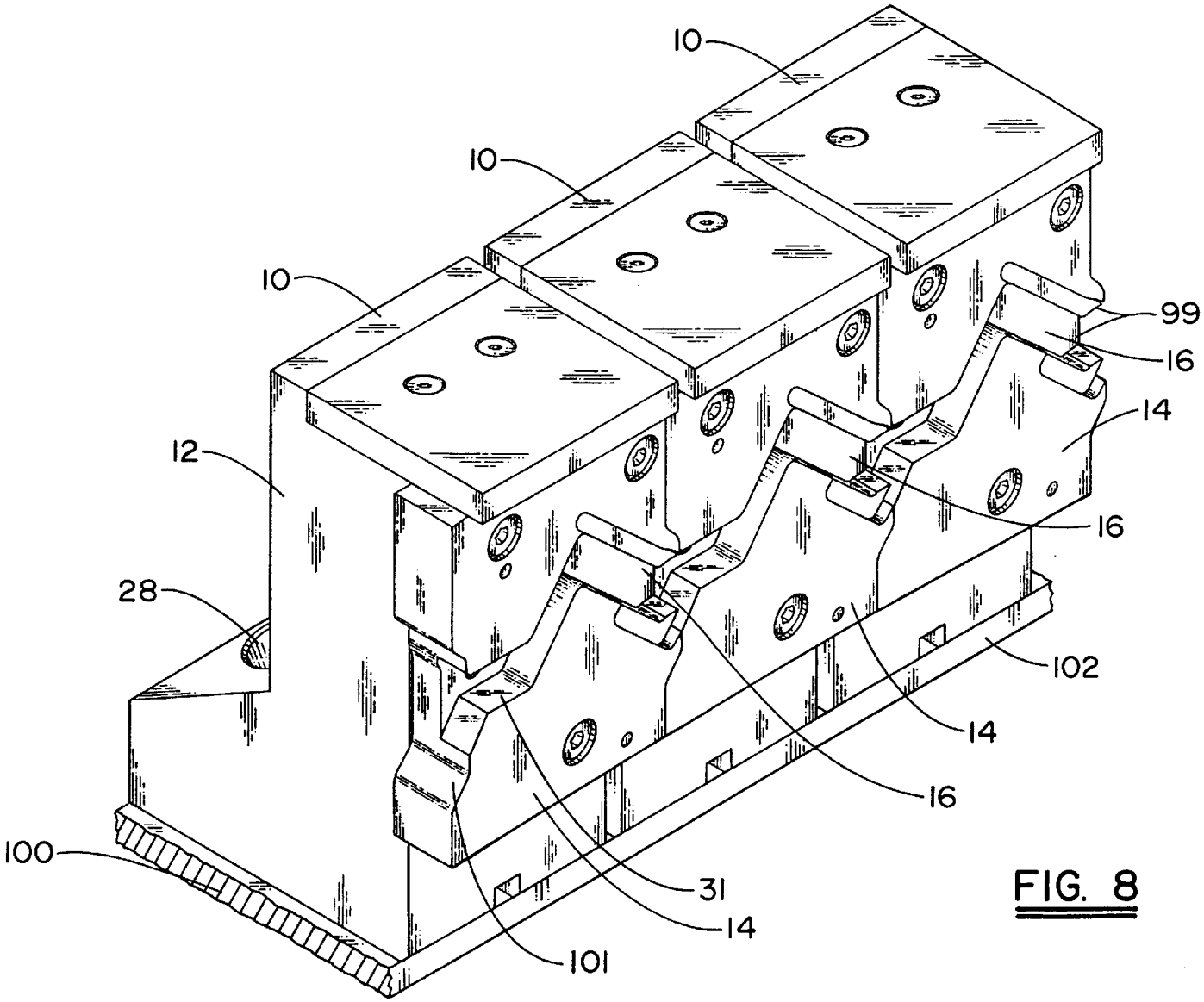
FIG. 8 is a partial front perspective view of adjacent stitch cam assemblies as disposed in a circular knitting machine.

The upward curving portions 95, 97 and the fixed cam plate 14 form an extending portion 99 for engaging an indented portion 101 of an adjacent cam assembly 10, as shown in FIG. 8.

A plurality of stitch cam assemblies 10 are illustrated in FIG. 8, adjacently arranged on a cam supporting element 100 as in a circular knitting machine having a predetermined radius. As noted, each stitch cam assembly 10 includes an indented entrance portion 101 for engaging an extending exit portion 99 to provide a continuous cam track 31.

Figure 9:
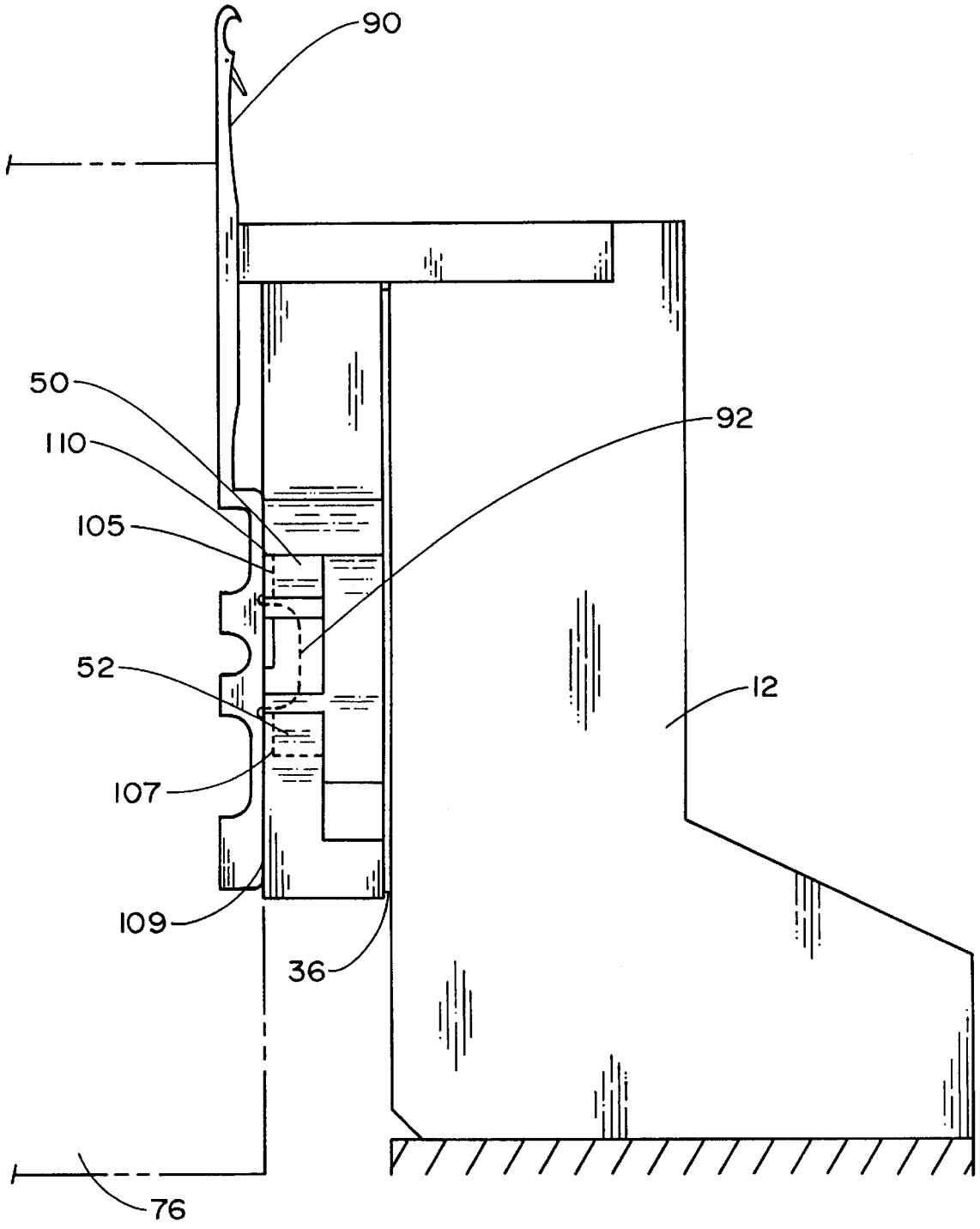
FIG. 9 is a side view of the stitch cam assembly of FIG. 6, as assembled, illustrating the positioning of the shim member to influence radial adjustment.
Figure 10:
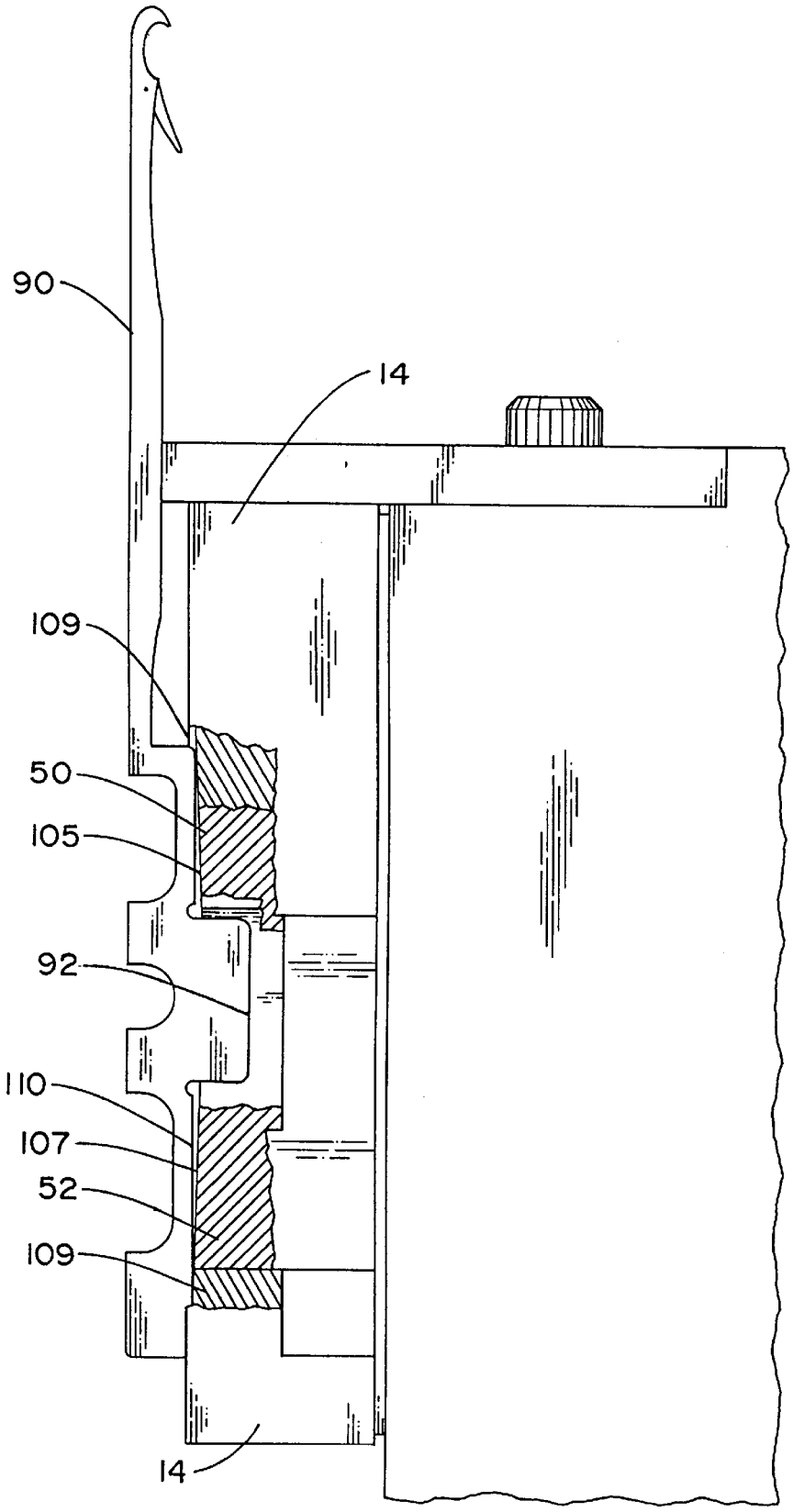
FIG. 10 is a partial sectional view of the stitch cam of FIG. 7 as taken through line 10—10 illustrating the geometry of a knitting needle relative to the front facing surfaces of the stitch cam.

Referring to FIGS. 9 and 10, there is shown between the stitch cam assembly 10 and a needle supporting member, i.e., the cylinder 76, having a supported knitting needle 90. The needle 90 includes the butt 92, shown in phantom, which is engaged within the cam track 31, FIG. 8, as well as a contacting profile 110 located directly above and below the butt, the profile having a slight outward taper immediately adjacent the butt of the needle.

As is shown, the introduction of the shim member 36 between the respective rear surfaces 58, 60 of the assembled cam plate assembly and the front facing surface 18 of the support body 12 provides radial adjustment between the stitch cam assembly 10 and the cylinder 76.

In addition, and due to the narrowness of the cam portions 50, 52 the contacting profile 110 of the illustrated needle 90 as supported by the cylinder 76, shown pictorially in the FIGS. 9 & 10 fails to contact either of the cam portions, but rather contacts only the front surface of the fixed cam plate 16. Preferably, in the manufacture of the movable cam plate 16, the front surfaces 105, 107 according to FIGS. 9 and 10 of the narrow cam portions 50, 52 are milled to a level which is coplanar or slightly undercut relative to the front surface 109 of the fixed cam plate 14. More preferably, the milling should take place at either extreme stitch level position, shown and described previously with reference to FIGS. 4 and 5.

The invention has been described in terms of a preferred embodiment. It will be readily apparent that other assemblies embodying the described concepts as contemplated from the appended claims as read to cover the spirit and scope of the invention.

I claim:

1. A stitch cam for a circular knitting machine using needles having butts of a predetermined size, comprising:

a support body having a front facing surface;

a fixed cam plate fixedly attached to said front facing surface;

a movable cam plate movably attached to said front facing surface, said cam plates defining a closed cam track having a spacing sized for accommodating the butt of said needles; and means for moving said movable cam plate relative to said fixed cam plate to alter the position of at least a portion of said closed cam track in order to selectively raise and lower the stitch level of said needles in a circular knitting machine; and means for adjusting the radial position of the stitch cam relative to the position of a needle supporting element of a circular knitting machine, said means including a shim member disposed between said cam plates and the front facing surface of said support body.

2. A stitch cam assembly as recited in claim 1, wherein said support body includes said means for moving said movable cam plate relative to said fixed cam plate, said means including an Archimedean spiral cam having an engageable cam surface on said front facing surface, in which said movable cam plate includes pin means interconnecting with said engageable surface to produce linear motion of said movable cam plate in response to rotational movement of said spiral cam.

3. A stitch cam as recited in claim 2, wherein said support body and said cam plates are dissimilar materials of different hardness, said shim member having an intermediate hardness to facilitate movement of said movable cam plate to adjust the closed cam track.

4. A stitch cam as recited in claim 3, wherein said fixed cam plate includes a cutout portion to accommodate said movable cam plate therein, said movable cam plate having upper and lower cam follower portions having a spacing sized for said accommodating the butts of said needles, said cutout portion defined along an oblique angle to allow a portion of said closed cam track to vary in height depending on the position of said movable cam plate in said cutout portion.

5. A stitch cam as recited in claim 4, wherein each said needle includes a contacting surface for contacting said stitch cam, and wherein said upper and lower cam portions of said movable cam plate are sized so that said contacting surface contacts only said fixed cam plate when the butt of said needle is engaged in the spacing between said first and second cam follower portions.

6. A stitch cam as recited in claim 5, wherein said movable cam plate and said fixed cam plate each include front surfaces which face a needle supporting element when said stitch cam is assembled into a circular knitting machine, wherein the front surface of said movable cam plate is coplanar with the front surface of said fixed cam plate.

7. A stitch cam as recited in claim 5, wherein said movable cam plate and said fixed cam plate each include front surfaces which face a needle supporting element when said stitch cam is assembled into a circular knitting machine, wherein the front surface of said movable cam plate is slightly further from said needle supporting element than the front surface of said fixed cam plate to insure the contacting portions of said needles do not contact said movable cam plate.

8. A stitch cam as recited in claim 3, wherein said support body is aluminum, said cam plates are a hardened steel, and said shim member is a half hardened steel.

9. A stitch cam as recited in claim 1, wherein said shim member can include variable thicknesses for varying the radial position of said stitch cam in a circular knitting machine.

10. A stitch cam for a circular knitting machine using needles having butts having a predetermined size, comprising:

a support body having a front facing surface;

a first cam plate fixedly attached to said front facing surface;

a second cam plate movably attached to said front facing surface, said first and second cam plates defining a closed cam track having a spacing sized for accommodating the butt of said needles; and means for moving said second cam plate relative to said first cam plate to alter the position of at least a portion of said closed cam track in order to selectively raise and lower the stitch level of said needles in a circular knitting machine, wherein the first cam plate includes a cutout portion for accommodating said second cam plate therein, said second cam plate including upper and lower cam portions which are spaced to define a portion of said closed cam track, and in which said spacing is sized to accommodate a butt of said needle, said needle having a contacting portion which contacts only said fixed cam plate when the butt of said needle is engaged between said upper and lower cam portions of said second cam plate.

11. A stitch cam as recited in claim 10, in which said contacting portion of said needle are tapering surfaces adjacent said butt, and in which said upper and lower cam portions include front facing surfaces which are coplanar or slightly inward of the front surface of said fixed cam plate.

12. A stitch cam as recited in claim 11, wherein said upper and lower cam portions each include a width dimension which is sufficiently narrow to prevent said needle contacting portion from contacting thereupon.

13. A stitch cam as recited in claim 10, including means for adjusting the radial position of a stitch cam, said means including a plurality of shim members having different thicknesses for placement between said cam plates and said support body to allow radial adjustment between said cam and a needle supporting member of said knitting machine.

14. A stitch cam as recited in claim 13, wherein said support body includes means for linearly moving said movable cam plate relative to said fixed cam plate, said means including an Archimedean spiral cam having an engageable portion on the front face of said support body.

15. A stitch cam as recited in claim 14, in which said movable cam plate includes means for engaging said engagement surface of said spiral cam, said cutout section including an obliquely angled portion defining a linear path of travel for said movable cam plate when said spiral cam is rotated.

16. A stitch cam as recited in claim 10, including means for adjusting the radial position of said cam relative to a needle supporting member when said cam is assembled into a circular knitting machine, said means including a shim plate which is positioned between the cam plates and the front facing surface of said support body.

17. A stitch cam as recited in claim 16, wherein said support body is aluminum and said cam plates are a hardened steel, and in which said shim plate is made from a material which facilitates movement of said cam plate.

* * * * *